US006889798B2

(12) United States Patent
Overby et al.

(10) Patent No.: US 6,889,798 B2
(45) Date of Patent: May 10, 2005

(54) APPARATUS FOR CONTROLLED STABILIZED DESCENT

(76) Inventors: Steven L. Overby, 130 Hintzen St., Miltona, MN (US) 56354; David R. Benjamin, 26001 Jivaro St., NW., Isanti, MN (US) 55040

( * ) Notice: Subject to any disclaimer, the term of this patent is extended or adjusted under 35 U.S.C. 154(b) by 329 days.

(21) Appl. No.: 09/801,188

(22) Filed: Mar. 7, 2001

(65) Prior Publication Data

US 2001/0030082 A1 Oct. 18, 2001

Related U.S. Application Data

(60) Provisional application No. 60/187,845, filed on Mar. 8, 2000.

(51) Int. Cl.[7] ..... E04G 1/18; E04G 3/10; A62B 37/00

(52) U.S. Cl. ..... 182/142; 182/145; 182/69.4; 182/127

(58) Field of Search ..... 182/142, 127, 182/63.1, 2.1–2.11, 69.4

(56) References Cited

U.S. PATENT DOCUMENTS 2,821,312 A * 1/1958 Wiegel
4,314,622 A * 2/1982 Lindquist
4,643,273 A * 2/1987 Stokoe
5,445,032 A * 8/1995 Dixon

FOREIGN PATENT DOCUMENTS

FR 2735507 * 12/1996

* cited by examiner

*Primary Examiner*—Alvin Chin-Shue
(74) *Attorney, Agent, or Firm*—Merchant & Gould P.C.

(57) ABSTRACT

An apparatus for descent, suspension and retrieval of a worker through an opening in the ground includes a trailer having a boom assembly mounted thereon is described. The boom assembly includes telescopically extensible and retractable boom members that are extended downwardly by action of gravity through opening to a subsurface location. The worker is supported in a stabilized manner during descent, suspension, and retraction of the boom members.

5 Claims, 4 Drawing Sheets

APPARATUS FOR CONTROLLED STABILIZED DESCENT

This application claims the benefit of Provisional Application No.60/187,845, filed Mar. 8, 2000.

FIELD OF THE INVENTION

This invention relates to an apparatus for use in the stabilized descent, suspension, and retrieval of a worker and equipment through an opening to an underground location.

BACKGROUND OF THE INVENTION

In the course of accomplishing various construction, maintenance, and supervision tasks, people must often work underground, such as when working in a underground sewer or communications enclosure. These people are required to move vertically downwardly through a confined space entry to a below surface location where the work is to be performed. In other instances, rescue personnel descend through a confined space entry when making a rescue of a person located at some underground location. In many instances, there are no support structures, such as ladders, for supporting a person engaged in underground work or rescue efforts.

Devices have been developed for supporting workers or rescuers descending through a confined space entry to an underground location. For example, Elvin Safety Supply, Inc. markets systems having tripod and davit arm for descent and retrieval of workers through a confined space entry. In the Elvin system a worker is suspended by a cable from the tripod or davit arm device. The use of a suspension cable in this type of descent and retrieval system allows the worker to swing uncontrollably within the underground space, which renders this system unstable for the worker and inadequate for many purposes. Other types of prior art devices embody very large expensive and cumbersome systems used essentially by urban sewer districts for underground work. These large systems also suspend the worker support by cables.

The primary problem with these prior art systems is their incapability of providing stabilized descent, suspension, and retrieval of a worker or rescuer. Therefore, a need exists for a device permitting descent of a worker into an underground space or confined space that provides controlled and stabilized descent, suspension, and retrieval.

SUMMARY OF THE INVENTION

An object of this invention to provide a novel apparatus for use in providing stabilized descent and retrieval of a worker or rescuer through a surface entry to and from an underground location.

A more specific object of this invention is to provide an apparatus for the stabilized descent, suspension and retrieval of a worker supported on a support connected to extensible and retractable elongate boom members which are extended downwardly by action of gravity through an opening to an underground location and which are retracted by power means for retrieving the worker support.

The apparatus includes a boom assembly mounted on a vehicle and including extensible and retractable telescopic boom members. The boom assembly is shiftable between operative and inoperative positions. The boom assembly is generally vertically oriented in an operative position and is provided with a worker's support basket that descends through an opening in the surface to an underground location. A power driven winch serves to retract the boom members to a retracted position from an extended position. The power driven winch also retains the boom assembly in the retracted position but permits the boom assembly to descend downwardly by action of gravity.

DETAILED DESCRIPTION

Figure 1:
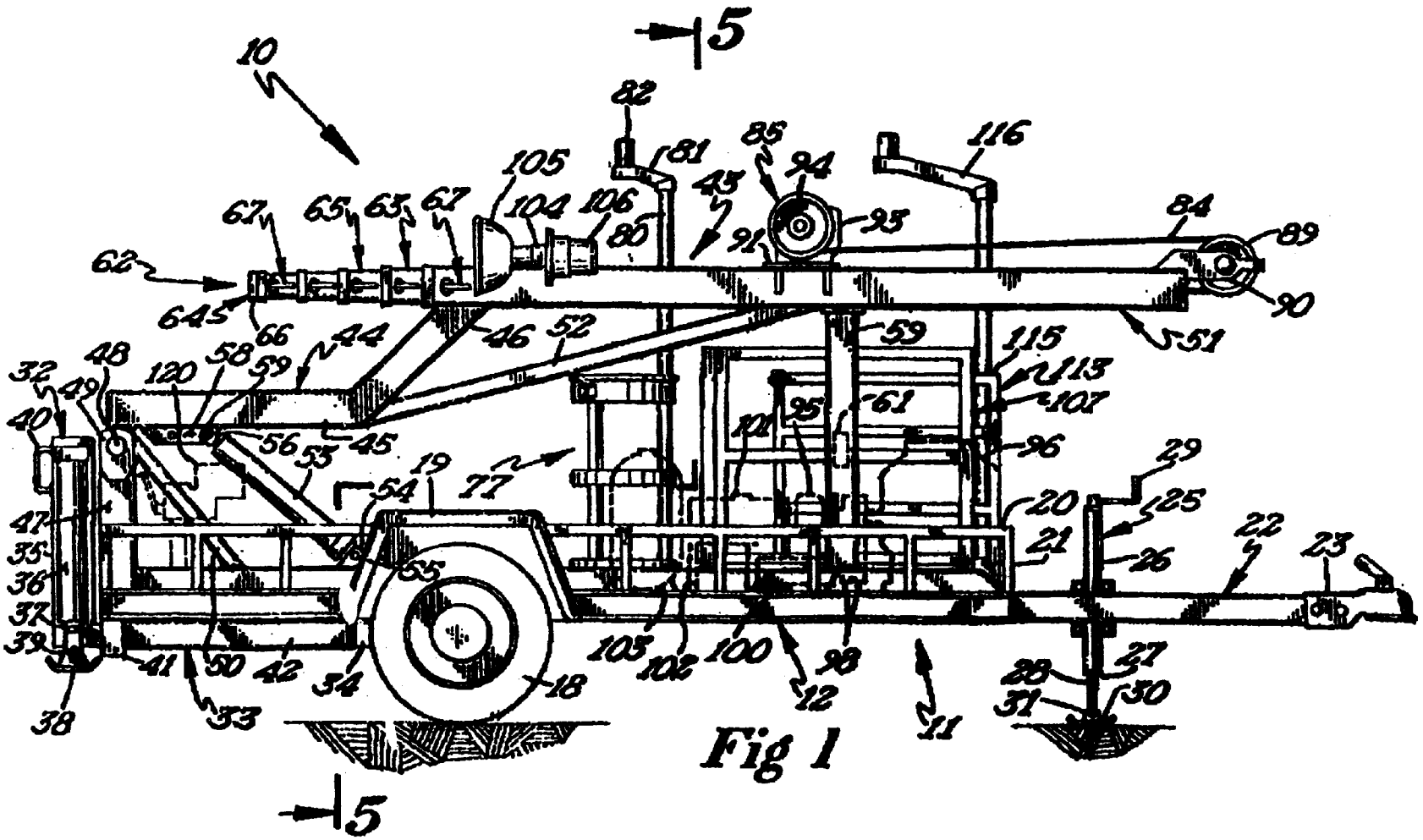
FIG. 1 is a side elevational view of a device for lowering a person into a subterranean space, illustrating the boom assembly in a retracted inoperative position.

The present invention is directed to an apparatus for the descent and retrieval of a worker through an opening in a surface leading to a sub-surface location. The apparatus comprises a boom assembly having a plurality of elongate moveable boom members; and a support secured to the boom assembly for supporting a person to provide stabilized descent, suspension, and retraction of the person into a sub-surface location.

In certain embodiments the apparatus is configured such that at least some of the plurality of elongate moveable boom members are configured to telescope by sliding into the interior of other moveable boom members. In this manner the boom provide a compact but stable apparatus for entry into subsurface space. The telescoping form of the boom members allows the support to travel through a relatively small opening. Also, the boom members are optionally pivotable with respect to the surface and can be configured to rotate within at least one direction. The boom assembly is configured to rotate within at least two directions in some implementations, and may include means for limiting extensible movement of each boom member. This ability to pivot or rotate allows the support to be centered over the opening without relocating the entire apparatus, and also allows the support to be repositioned horizontally when underground.

A remote control can be used for controlling operation of the apparatus from underground. Specific embodiments also include a power means for raising and lowering the support. Normally the apparatus is secured to a mobile transport device, such as a trailer or the bed of a vehicle. In an example implementation the boom assembly can be contracted and disposed in a substantially horizontally position when not in use, and then raised into a vertical position when in an operative position when used Referring now to the drawings and more particularly to FIGS. 1 and 2, it will be seen that one embodiment is shown of the novel apparatus, designated generally by the reference number 10. The apparatus 10 includes a mobile vehicle comprising a trailer 11 that is adapted to be towed by truck, tractor or similar prime mover. It is pointed out that while the preferred embodiment of the apparatus 10 includes a trailer, other kinds of transport vehicles such as pick-up trucks or similar type vehicles may be used. Thus, the device can be mounted on a trailer or an be mounted directly to a powered vehicle, such as mounting within the bed of a truck.

In the depiction shown, the trailer 11 includes a generally rectangular shaped trailer frame 12 having elongate longitudinal side frame members 13 that are rigidly secured to front and rear elongate transverse frame members 14. The transverse frame members define the front and rear of the trailer. The transverse frame members and the longitudinal side are of hollow, rectangular shaped, cross-sectional configuration in the embodiment shown. A central elongate longitudinal frame member 15, of hollow, rectangular cross-sectional configuration, is rigidly secured to the transverse frame members at approximately their respective mid portions. A longitudinal sub-frame member 16 is secured to the lower surface of the central frame member and extends throughout the length of the latter. Longitudinally spaced apart transverse ribs 17 rigidly interconnect the longitudinal sub-frame member 16 with the longitudinal frame members 13. The trailer 11 has suitable ground engaging wheels 18 for support of the trailer over the surface of the ground. The ground engaging wheels are provided with fenders 19 of well-known construction.

Figure 2:
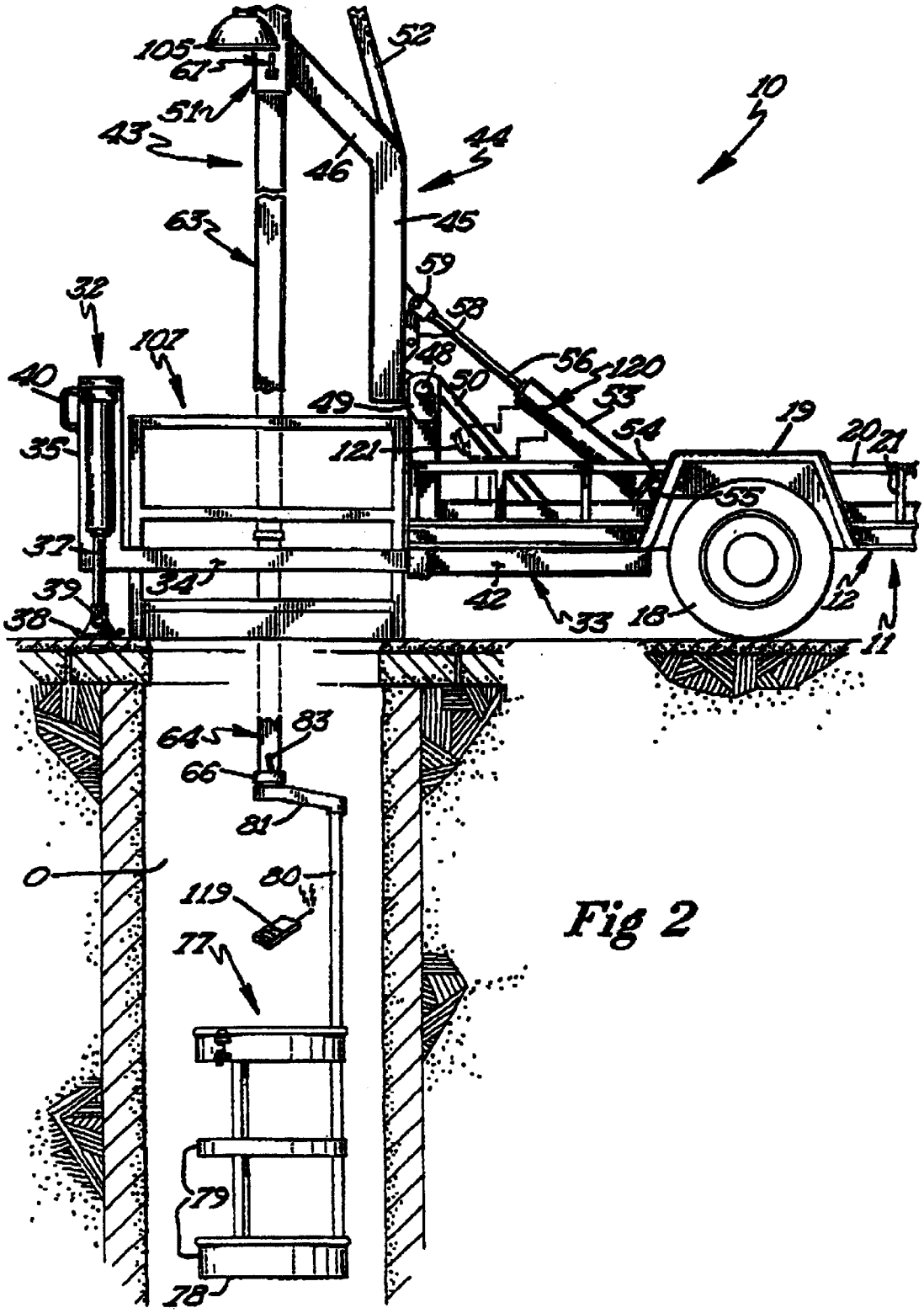
FIG. 2 is a side elevational view of the device for lowering a person into a subterranean space and with the boom assembly in an extended condition.

The trailer is provided with peripheral railings including the longitudinal side railings 20 that are rigidly interconnected at their ends to front and rear transverse railings 21. The side railings 20 are also connected to the fenders 19, as best seen in FIGS. 1 and 2. It will therefore be seen that the railings extend around the entire periphery of the trailer and prevent any components supported on the trailer from accidentally sliding from the trailer.

The trailer is provided with an elongate hitch bar 22 at its front end, which is secured to the front end of the central longitudinal frame member 15 and projects longitudinally therefrom. A socket type coupling 23 is secured to the front end of the elongate hitch bar and is part of a ball and socket coupling of well-known construction. The trailer is also provided with a flat deck 24 upon which the various components of the apparatus are supported.

The elongate hitch 22 which projects from the front end of the trailer frame is provided with a trailer jack 25 rigidly secured to the hitch bar intermediate the ends thereof. The trailer jack 25 includes a vertically disposed elongate tube 26 having a nut 27 secured to the lower end thereof. An elongate jackscrew 28 projects through the tube and threadedly engages the nut 27. A handle 29 is rigidly secured to the upper end of the jackscrew 28 and facilitates adjustment of the trailer jack. The lower end of the jackscrew 28 is provided with a footplate 30, which is pivotally connected to the jackscrew by pivot 31. The jackscrew is of well-known construction and provides a means for conveniently leveling the front end of the trailer.

The trailer 11 is also provided with a pair of substantially identical outriggers 32 at its rear end, as seen in FIGS. 1 and 2. The outriggers serve to support and stabilize the rear end of the apparatus when the apparatus is in an operative position. Each outrigger 32 is comprised of an L-shaped mounting member 33 including a horizontal member 34 and a vertical member 35. A vertically disposed double acting hydraulic cylinder 36 is rigidly secured to the vertical member 35. The hydraulic cylinder 36 is provided with a piston rod 37 which projects downwardly from the lower end of the cylinder. A ground-engaging footplate 38 is pivotally secured to the lower end of the piston rod by a pivot 39. Each outrigger 32 is also provided with a U-shaped handle that is rigidly secured to the upper end portion of the vertical member 35 to facilitate movement of the outrigger.

Each outrigger is moveable from a retracted inoperative position, as illustrated in FIG. 1, to an extended operative position, as depicted in FIG. 2. The horizontal mounting member 34 of each outrigger projects through an opening in a bumper 41 which is secured to the rear transverse frame member and projects downwardly therefrom. An elongate horizontal, longitudinally extending guide 42 is secured to the lower portion of the trailer frame and is disposed in communicating relation with the opening through the bumper 41. The horizontal mounting arm 34 slides in the horizontal guide 42 during movement of the associated outrigger between the retracted inoperative and extended operative positions.

It is pointed out that when the outriggers are moved to the outward operative position, the piston will be actuated to extend the piston rod 37 downwardly until the footplate 38 engages the surface of the ground. Conversely, when the outriggers are moved to the inoperative position, the piston rods 37 will first be retracted and outriggers will then be moved in a forward direction to the retracted inoperative position.

The apparatus 10 includes a boom assembly 43 that is pivotally mounted on the trailer 11 for swinging movement between a vertical operative position and a horizontal inoperative position. The boom assembly 43 includes an elongate mounting arm 44 of angular configuration including a lower arm section 45 and an upper arm section 46 which is integral with the lower arm section and extends angularly therefrom. The lower end of the elongate mounting arm 44 is pivotally connected to the upper end of a vertically disposed post 47 by a pivot 48 as best seen FIG. 1. In this regard, the post 47 is rigidly affixed to the central longitudinal frame member 15 at the rear end thereof. The post 47 is vertically disposed and is provided with a clevis 49 at its upper end, which accommodates the pivot 48. An oblique strut 50 is rigidly affixed to and extends between the trailer and the vertical post 47. In other implementations of the invention the elongate mounting arm can be formed such that it is a single piece.

The boom assembly 43 also includes an elongate substantially straight hollow mounting boom member 51 which is optionally of rectangular cross-sectional configuration and which is rigidly secured at one end thereof to the end of the upper arm section 46, as best seen in FIG. 1. It will be noted that the end of the mounting boom member 51 to which the upper arm section is affixed is the lower end of the mounting boom member. An elongate substantially oblique brace 52 is rigidly secured to the mounting arm 44 at approximately the juncture of the upper and lower arm sections thereof. The other end of the oblique brace 52 is rigidly secured to the mounting boom member 51 adjacent the mid portion thereof. It will therefore be seen that the boom assembly 43 is swingable between an inoperative horizontal position, as illustrated in FIG. 1, about a horizontal transverse axis and a vertical operative position, as illustrated in FIG. 2. When the boom assembly is in the operative position, the mounting boom member 51 will be disposed in a vertical or substantially vertical position.

The boom assembly 43 can be shifted between the operative and inoperative positions by various powered devices, such as a double acting hydraulic cylinder 53 which has one end thereof secured to a clevis 54 by pivot 55. It will be noted that the clevis 54 is rigidly secured to the upper surface of the central longitudinal frame member 15 of the trailer frame 12 in the implementation shown. The hydraulic cylinder 53 is provided with a piston having a piston rod 56 secured thereto and projecting therefrom. The end of the piston rod 56 is provided with a clevis that is secured by a pivot 57 to an apertured bracket 58. The apertured bracket 58 is rigidly secured to the lower end portion of the lower arm section 45 and, in the embodiment shown, a plurality of apertures are formed in the bracket. The openings or apertures in the bracket 58 allow adjustable attachment of the piston rod to the bracket. It will be seen that when the piston rod 56 is extended, the boom assembly 43 will be moved from the inoperative position, as illustrated in FIG. 1, to the operative position illustrated in FIG. 2. Conversely, when the piston rod 56 is retracted, the boom assembly will then be shifted to the horizontal inoperative position, as illustrated in FIG. 1.

In the embodiment shown a vertically disposed support post 59 is provided for supporting the boom assembly 43 in the inoperative horizontal position as best seen in FIG. 1. The support post 59 is also rigidly secured at its lower end to the central longitudinal frame member 15 and projects upwardly therefrom. A substantially flat rectangular support plate 60 is rigidly affixed to the upper end of the support post 59 and provides a supporting surface for supporting the boom assembly 43 in the inoperative position. The support post 59 is also provided with an L-shaped support bracket 61 rigidly affixed to one side thereof and projecting outwardly therefrom. The function of the L-shaped support bracket 61 will be more fully described hereinbelow. Finally, it will be noted that support post 59 has a vertical dimension greater than the vertical dimension of the post 47. It will be noted that the mid portion of the mounting boom member 51 engages and rests on the support post 59 when the boom assembly 43 is in the inoperative horizontal position.

The boom assembly 43 also includes a moveable boom structure 62 that is telescopically extensible and retractable with respect to the mounting boom member 51. The moveable boom structure is comprised of a plurality of substantially straight hollow moveable boom members. In the implementation shown, the boom members have rectangular cross-sectional configuration, and include a proximal boom member 63, a distal boom member 64, and a plurality of intermediate boom members 65. These boom members telescope within each other and within the mounting boom member 51 when in a fully retracted position and are extended telescopically to their full extension when in a fully extended position. However, it is pointed out that the moveable boom members can be variously adjusted between the fully retracted and the fully extended positions.

In a specific embodiment, each of the moveable boom members is approximately ten feet long and six such boom members are preferably used in the moveable boom structure to permit the boom members to be extended to a depth of approximately slightly less than sixty feet.

However, it is pointed out that the moveable boom structure may be comprised of boom members of different lengths and configurations, and different numbers of boom members may also be used. For example, although the preferred embodiment utilizes six boom members in order to obtain a depth of approximately sixty feet, fewer boom members of greater length could also be used to achieve a similar or different depth. However, it is pointed out that it is preferred that moveable boom structure 52 be comprised of at least two moveable boom members.

Since the moveable booms telescope within each other, the boom members diminish in cross-sectional size beginning with the proximal boom member 63 and ending with the distal boom member 64. The proximal boom member 63 is of course also smaller in cross-sectional size than the mounting boom member 51. The outer ends of each of the moveable boom members can be provided with an out turned annular flange 66.

The extensible movement of the moveable boom member relative to each other and relative to the mounting boom member 51 is normally limited. This limiting can be accomplished by a pair of opposed locking mechanisms 67 for each of the boom members (normally with the exception of the distal boom member). It will also be noted that the mounting boom member 51 is also provided with a pair of locking mechanisms 67. Each opposed pair of these locking mechanisms is located adjacent the lower end portion of the associated boom member. Each locking mechanism 67 includes a pair of ears 68 which are secured to the associated boom member. The ears are apertured and a locking pawl 69 is secured to the ears by pivot 70. Each locking pawl 70 includes a camming surface 71 which is somewhat curved and is positioned to slide along the external surface of the adjacent moveable boom member as the boom member is moved. Each pawl 69 also includes a locking surface 72 that is straight and defines one end of the locking pawl.

The upper end portion of each of the moveable boom members is also provided with a pair of opposed openings 73 therein, each opening defining a locking edge 74. The locking pawl 69 of each locking mechanism 67 is urged in a direction against the adjacent moveable boom member by a jack spring 75, which is secured to the pivot 70 of each locking mechanism.

Each locking mechanism 67 includes an opening 76 in the associated boom member through which the locking pawl 69 projects. When the moveable boom members are in the retracted position, the locking pawls 69 for each pair of locking mechanisms will be urged outwardly into an unlocked condition. When the moveable boom members are extended, the locking pawl will be cammed outwardly by the moving adjacent boom member until the locking pawls are urged by the jack springs 75 into the opening 73. Each opening 76 will communicate with an opening 73. When this occurs, the locking edge 74 defined by the opening 73 will engage the locking surface 72 of the locking pawl thereby limiting any further extensible movement of the associated boom member. The proximal boom member 63 will also be limited in its extensible movement by the pair of locking mechanisms 67 mounted on the mounting boom 51.

A support or basket 77 for a worker is attached to the distal boom member 64 of the boom assembly. In the embodiment shown in FIG. 3, the support is in the form of an open top cylindrical basket 77 for accommodating a single worker. The basket 77 has a bottom wall 78 and vertical frame elements 79 secured to the bottom wall and projecting upwardly therefrom. Vertically spaced apart upper, intermediate and lower annular frame elements **79*a* are secured to the vertical frame elements. The upper annular frame element is of sectional construction and defines a gate 79*b* to allow a worker to access the basket 77**.

An elongate vertically disposed hanger arm 80 is rigidly secured to the annular frame elements **77*a* of the worker's basket 77 and extends upwardly therefrom. The hanger arm is substantially straight and includes an intermediate offset portion 81 extending at right angles thereto. The hanger arm terminates in an upward end portion 82, which is disposed at right angles to the intermediate portion 81 and is substantially parallel to arm 80. The upper end portion 82 projects into the distal end of the distal boom member and is secured thereto by a pin 43. It is pointed out that the worker's support 77** cannot swing or rotate and remains stable during descent, suspension and retrieval to and from the underground work location.

Means are provided for retracting the moveable boom structure from the extended position and for controlling downward extension of the boom section to an extended position. This means includes an elongate flexible cable 84 which has one end thereof secured to a power driven winch assembly 85 mounted on the mounting boom member 51. The other end of the cable 84 is secured to the upper end portion of the distal boom member 64. In the embodiment shown, the lower end of the cable 84 is secured to a hook 86 having a spring urged keeper 87. A cross bar 88 extends transversely across the upper end portion of the lower distal member and is engaged by the hook 86 to anchor the end of the cable to the distal boom member.

The cable 84 is trained over a pulley 89 secured to the upper end of the fixed boom member by a bracket 90. In the embodiment shown, the power winch assembly 85 is secured to a bracket 91, which in turn is secured to the mounting boom member 51. The power winch assembly 85 includes a hydraulic motor 92 secured to the bracket 91 and having an output shaft shown (not shown) which is drivingly connected to the components of a gear reduction box 93.

The output shaft of the gear reduction box is drivingly connected to the winch unit 94 about which the cable 84 is wound. The hydraulic motor 92 is reversible and when it is driven in one direction, the cable 84 will retract the moveable boom members from an extended position in a retracting direction. When the hydraulic motor is driven in the opposite direction, the cable will be unwound from the winch as the boom members are extended. Downward extension of the moveable boom members is by action of gravity.

In the embodiment depicted, a reversible hydraulic pump 95 mounted on the deck 24 of the trailer 11 drives the reversible hydraulic motor 92. A twenty (20) horsepower (HP) Honda engine 96 also mounted on the trailer deck and whose output shaft is drivingly connected to the hydraulic pump 95 drives the hydraulic pump 95. The output shaft of the 20 HP Honda engine is provided with drive pulleys 97 having belts 98 trained thereover, as best seen in FIG. 2. The belts 98 are also trained about driven pulleys 99 which are mounted on the input shaft of an electric generator 100. The generator is mounted on the deck closely adjacent the hydraulic pump and 20 HP Honda engine.

A hydraulic fluid reservoir 101 is mounted on the deck adjacent the hydraulic pump and the reservoir is part of the hydraulic circuit for the hydraulic pump. An electric storage battery 102 and a fuel tank 103 containing fluid for the Honda engine are also mounted on the deck.

Referring again to FIGS. 1 and 2, it will be seen that a substantially flat generally rectangular shaped bracket 104 is rigidly secured to the mounting boom member 51 adjacent the lower end portion thereof in the specific example embodiment shown. This mounting bracket has a pair of floodlights 105 attached thereto and the floodlights face in a rear direction when the boom assembly is an inoperative horizontal position, but face downwardly when the boom assembly is in the operative erect position. The bracket 104 also serves to mount a pair of laterally spaced apart rotating flashing warning lights 106. When the boom assembly is in the vertical operative position, the warning lights will be disposed above the opening in the ground surface and will be at a level to be readily seen by a person in that vicinity. The floodlights and warning lights are connected by suitable conductors (not shown) to the generator battery electrical system.

The apparatus can also be provided with a portable, knockdown barrier or fence structure 107 that is rigidly positioned around the entry opening in the surface of the ground to prevent a pedestrian from inadvertently falling into the opening. The barrier or fence structure 107 includes a pair of similar longitudinal, fence members 108 which are releasably connected to a transverse fence member 109 by suitable latching means 110. When the latching means 110 are unlatched, three fence members are disconnected and may be separately removed. The rear transverse frame member 14 of the trailer frame 12 is provided with a pair of laterally spaced apart apertured ears 111 which receive pins from the longitudinal fence members 108. This arrangement allows the barrier structure 107 to be secured to the rear transverse frame member of the trailer frame 12 when the boom assembly is in the vertical operative position.

The barrier structure 107 is disassembled for transport. When in the disassembled condition, the fence members are supported by the bracket 61 on the post 59. In certain instances, the underground work to be performed may require more than one worker. However, the basket 77 cannot accommodate more than a single worker. Therefore a generally rectangular shaped multiple man support or basket 113 is provided having a bottom wall 114 and upright opposed side walls 115 of open framework construction. The basket 113 also has a hinged gate 116 provided with a latch to permit the opening, closing and locking of the gate.

Figure 3:
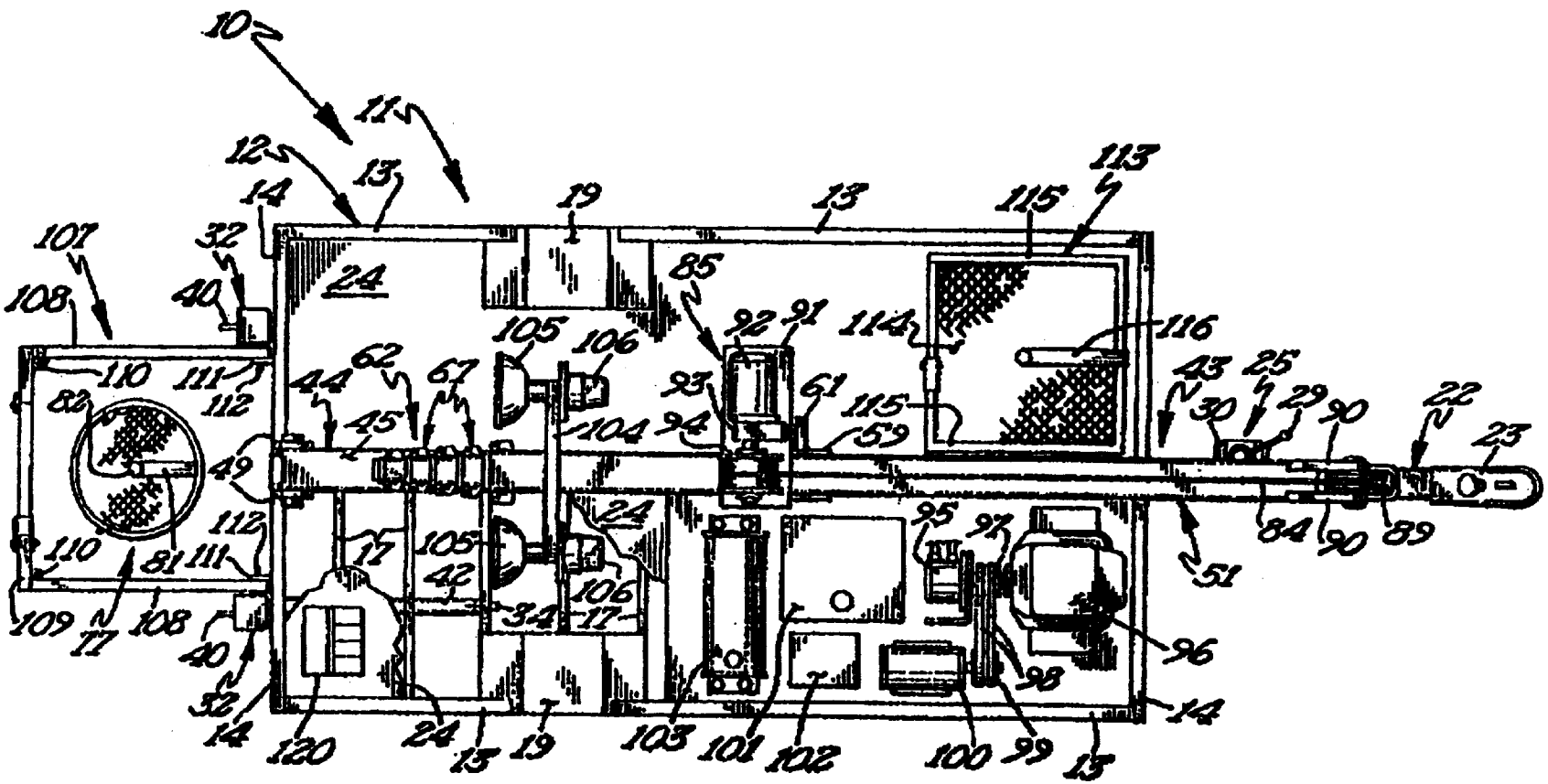
FIG. 3 is a top plan view thereof.

The multiple man support is also provided with a hanger arm 117 which is substantially identical in construction to the hanger arm 80 disclosed in the embodiment of FIG. 3. The manner in which the multiple man support 113 is attached to the lower end of the distal moveable boom member is substantially the same as that disclosed in FIG. 3.

When the apparatus is used to make a repair at an underground location, the apparatus trailer will be attached to a towing vehicle and moved to the desired location. The boom assembly will be in the horizontal inoperative position as illustrated in FIG. 1 during travel to the location. When the apparatus arrives at the desired location, the trailer will be positioned adjacent the opening or vertical shaft o where the work is to be performed. The outriggers will be angularly pulled outwardly to the extended operative position and the hydraulic cylinders 36 will be actuated to extend the piston rods to the extended position so that the foot plate 38 for each outrigger engages the surface of the ground. The double acting hydraulic cylinder 53 will then be extended to raise the boom assembly 43 to the erect operative position so that the mounting boom and moveable boom structure is positioned directly over the center of the vertical shaft. The barrier structure 107 will be assembled and attached to the rear of the trailer in obstructing relation with the respect to the shaft.

A control device 120 for operating the winch assembly 86, the double acting cylinder 53 and the outriggers 32 are located on the trailer and the control device is designated by the reference numeral 118. The control device 120 includes four levers 121 for manually actuating each of the outriggers, the cylinder 53 and the winch assembly 85. Control valves (not shown) are operated by the levers. The control valves may be conventional spool valves with an "off" position and reversible "on" positions. The control device 120 also includes four solenoids (not shown) for operating the valves by an operator located in the basket. In this regard, a remote unit 119 is provided to allow an operator to control the control valves.

When the boom assembly is in the operating position and the apparatus is ready for extension downwardly, a worker will enter the basket 77 and the control valve for operating the winch assembly will be actuated to unwind the cable 84 from the winch. The flood lights will be energized to illuminate the interior of the shaft. As the cable unwinds, the moveable boom sections will extend downwardly by action of gravity. The descent will be controlled at the rate of unwinding of the cable. Thus the angular velocity of the winch determines the descent rate.

The moveable boom structure will be extended until the operator reaches the desired location. As pointed out above, the control valves for operating the moveable boom structure may be controlled by the operator in the worker's support or may be controlled by an operator located t the surface. In any event, the worker will reach the desired location and then perform the necessary work.

Figures 4, 5, 6:
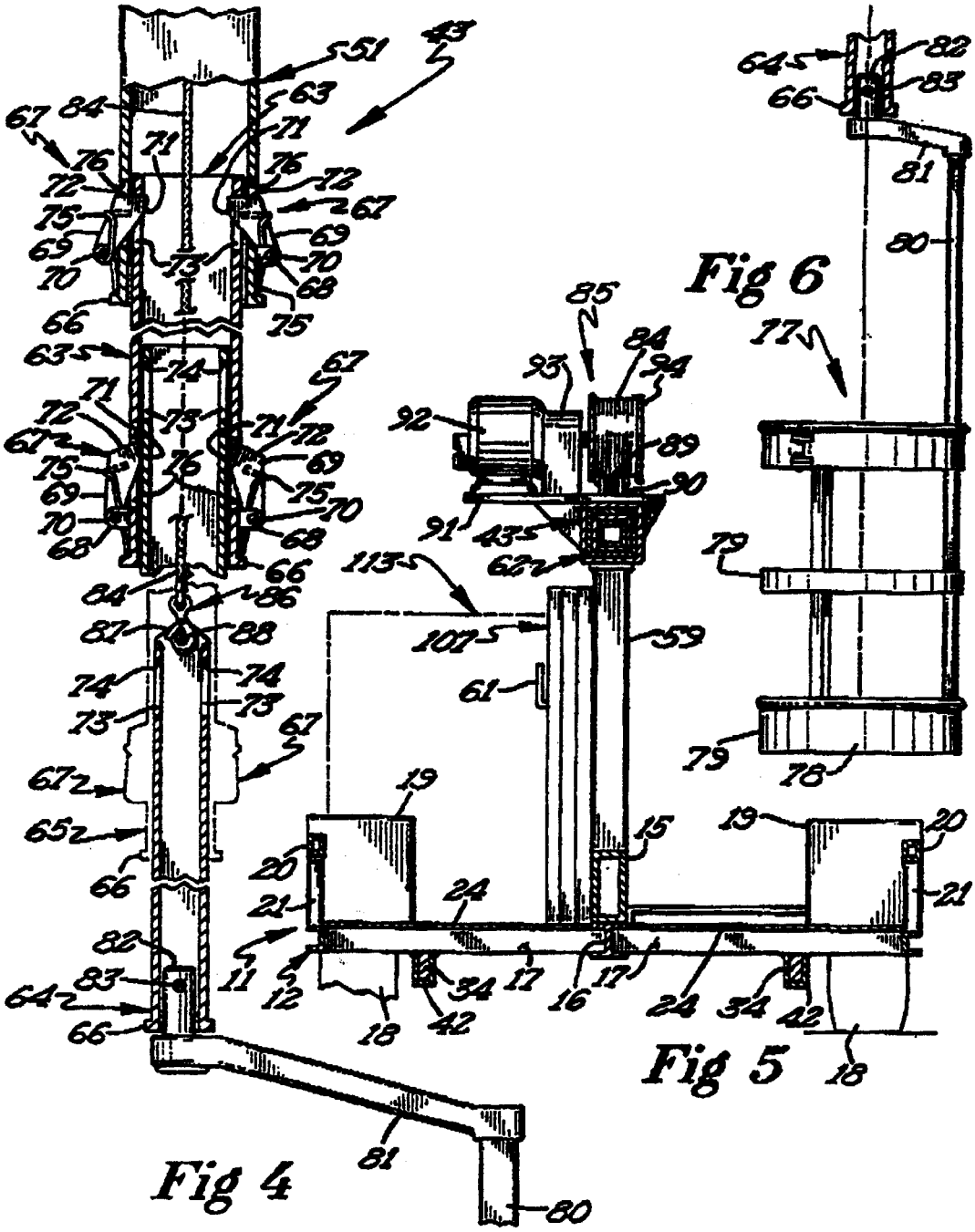
FIG. 4 is a fragmentary side elevational view of the device for lowering a person into a subterranean space with the boom assembly in the extended position.
FIG. 5 is a cross-sectional view taken approximately along line 5—5 of FIG. 1 and looking in the direction of the arrows.
FIG. 6 is a side elevational view of a portion of the device, including a worker support.

It again will be noted that moveable boom assembly and the worker's support 77 will be maintained in a stable condition during descent, suspension and retrieval. In this regard, attention is directed to FIG. 6, which illustrates the worker's support 77, and its relation to the moveable boom assembly 62 in one example implementation of the invention. The longitudinal axis or center line of the moveable boom assembly is co-extensive with the longitudinal center line of the support 77. Therefore as the boom is extended, there will be no side loading of the worker's support or the moveable boom members as the boom members are telescopically extended.

If any of the moveable boom members are extended to their full telescopic extension, then the locking mechanism 67 will limit any further movement of the associated boom member in an extensible direction. After the work has been completed or it is otherwise desirable to retract the boom assembly, the controls may be actuated to cause the cable 84 to be wound about the winch of the winch assembly to the fully retracted position or to a different location. Again it will be noted that the retractive movement of the moveable boom structure permits the worker's support 77 to be maintained in a stable condition against side loading or rotative movement.

Thus it will be seen that I have provided a novel apparatus for providing stabilized descent, suspension and retrieval of a worker's support, which permits a stabilized platform for allowing a worker to perform work at an underground location.

What is claimed is:

1. An apparatus for the descent and retrieval of a worker through an opening in a below-the-surface location, comprising:

a mobile transport device, a boom assembly, means for pivotally securing the boom assembly to the mobile transport device for pivotal movement of the boom assembly between an inoperative position and a vertical operative position, said boom assembly including an elongate mounting boom member, an extensible and retractable moveable boom structure mounted on said mounting boom member and being variously adjustable between a fully extended position and a fully retracted position, said moveable boom structure comprising a plurality of elongate moveable boom members including a distal boom member and a proximal boom member, said moveable boom members being telescopically disposed within the proximal boom member when in the fully retracted position and being telescopically extended to its maximum length in the fully extended position with the boom positioned such that it telescopes into a below-the-surface location, a support for supporting a worker thereon and having a vertical center line, means securing the support to the distal boom member to dispose the vertical center line of the support in coextensive relation with the longitudinal center line of the moveable boom members, and power means connected to the distal boom member and being operable to vertically retract the boom assembly upwardly from an extended position to a retracted position and to retain said moveable boom assembly in a retracted position, said power means being operable to release the boom members from a retracted position and permit controlled downward extension of the moveable boom members by action gravity.

2. The apparatus of claim 1 and means for limiting extensible movement of each moveable boom member.

3. The apparatus of claim 1 and means for limiting extensible movement of the proximal boom member relative to the mounting boom member.

4. The apparatus of claim 1, wherein the movable boom members have a rectangular cross section.

5. The apparatus as defined in claim 1 wherein said mobile transport device has front and rear ends, said boom assembly positioned adjacent the rear end of the mobile transport device when the boom assembly is in the vertical operative position.

* * * * *